United States Patent [19]

Heimlicher

[11] 4,041,683

[45] Aug. 16, 1977

[54] MACHINE FOR COILING LAMP FILAMENTS

[75] Inventor: Peter Heimlicher, Thorishaus, Switzerland

[73] Assignee: Gluhlampenfabrik A.G., Fribourg, Switzerland

[21] Appl. No.: 556,532

[22] Filed: Mar. 10, 1975

[30] Foreign Application Priority Data

Jan. 7, 1975 Switzerland ..... 74/75

[51] Int. Cl.[2] ..... H01B 13/00; H01B 13/08; B65H 81/08

[52] U.S. Cl. ..... 57/18; 57/106

[58] Field of Search ..... 57/16, 17, 18, 19, 106; 242/7.08, 7.09, 7.14; 72/66; 140/71.5, 71.6

[56] References Cited

U.S. PATENT DOCUMENTS

| | | | |
|---|---|---|---|
| 2,242,376 | 5/1941 | Stoker | 57/18 |
| 2,331,240 | 10/1943 | Selvig | 57/18 |
| 3,130,534 | 4/1964 | Ostermann | 57/9 |
| 3,236,039 | 2/1966 | Fletcher, Jr. et al. | 57/18 |
| 3,304,705 | 2/1967 | Rathje et al. | 57/18 |
| 3,315,508 | 4/1967 | Mikina et al. | 72/66 |
| 3,555,801 | 1/1971 | Scher | 57/18 |
| 3,701,244 | 10/1972 | Dismon et al. | 57/18 |
| 3,724,190 | 4/1973 | Balbatun et al. | 57/18 |

*Primary Examiner*—John Petrakes
*Attorney, Agent, or Firm*—Werner W. Kleeman

[57] ABSTRACT

In a machine for coiling a filament-wire for incandescent lamps or gas discharge tubes, a support-wire is continuously fed through an axial bore of a high-speed spindle. A reel supplying the filament-wire is integral with the spindle near the outlet end of the bore where the filament-wire is helically wound on the support-wire after having passed over a guiding edge of an arm protruding from a rotor mounted for free rotation on the spindle. The guiding edge extends along a parabola having its focal point on a rim of the reel adjacent to the coiling location. A braking device acting on the rotor is automatically controlled for maintaining a constant tension on the filament-wire as a function of the decrease in the radius of supply of filament-wire on the reel.

3 Claims, 4 Drawing Figures

MACHINE FOR COILING LAMP FILAMENTS

Figure 1:
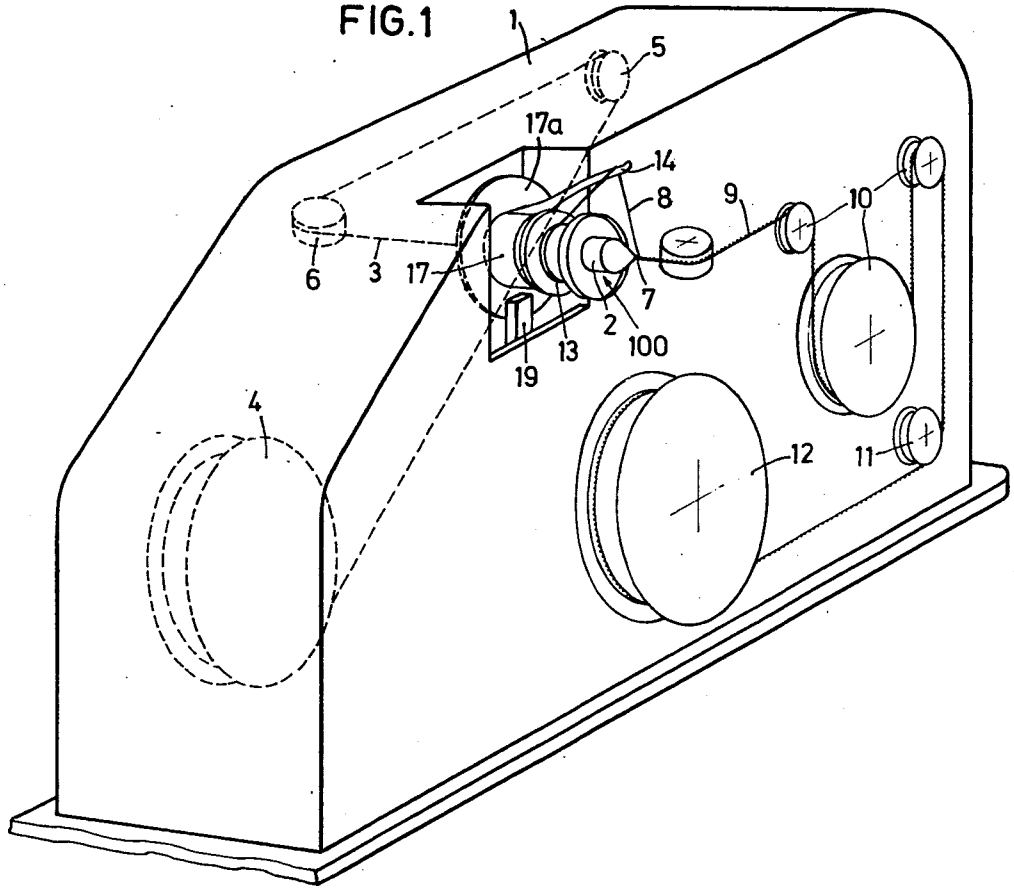

This invention relates to a machine for coiling filaments for incandescent bulbs or gas discharge tubes, comprising a hollow, motor-driven spindle, a supply reel holding a supply of filament-wire, a guide member, and motor-driven feed means for continuously advancing a support-wire through the spindle, the supply reel and the guide member being mounted on the spindle, the filament-wire describing a path between an unwinding location on the supply reel an a coiling location adjacent to one end of the spindle where the filament-wire is coiled on the support-wire, and the guide member being adapted to deviate the filament-wire along its path.

In a known machine, which has been sold under the name of "Swisscoiler" for many years now by Gluhlampenfabrik 15 A.G., Firbourg, Switzerland, the guide member is integrally mounted on the hollow spindle, while the supply reel is freely rotatable on that spindle.

It is the object of this invention to provide an improvement in that machine by maintaining a constant tension on the filament-wire, thus enabling the spindle to be rotated at a much greater speed and thereby increasing the rate of production, which is obviously directly proportional to that speed of rotation.

To that end, the machine according to the present invention further comprises a rotor mounted for free rotation on the spindle, the supply reel is integral in rotation with the spindle, and the guide member is an arm projecting from the rotor.

This design makes it much easier to eliminate any unbalance of the supply reel. Also eliminated is the effect produced upon the amount of tension on the wire by the mass moment of inertia of even a large supply reel, the use of which is actually desirable in order that the reels need not be changed so frequently. This has a particularly favorable influence on keeping the tension on the wire constant, for it is no longer the wire but rather the motor-driven spindle that is rotating the supply reel, the mass moment of inertia of which differs according to the weight of the wire it still holds.

A preferred embodiment of the invention further comprises a braking device acting upon the rotor and means for automatically controlling the braking device in order to keep the tension on the wire constant as the wind-off radius on the supply reel decreases.

In a further preferred embodiment, the guide member has a guiding edge extending along a parabola, the focal point of which lies on the rim of the supply reel nearest to the coiling location. As a result, the wire is drawn off the supply reel in a radial plane, and hence the drawing-off operation cannot be obstructed by adjacent turns of wire.

As regards the prior art, reference may also be made to Swiss Pat. No. 486,716, which teaches a device intended to serve the same purpose as the present invention. In that device, the wire, during its travel from the supply reel to the coiling location, froms a rotating loop which is subjected to centrifugal force, whereby the necessary wire tension is produced particularly in the section of the wire approaching the coiling location. However, this depends upon the specific gravity of the wire, among other things, and also upon the amount of wire still held on the supply reel at any given moment; hence it would appear to be difficult, if not impossible, to achieve a predetermined, truly constant wire tension with that device.

Figure 2:
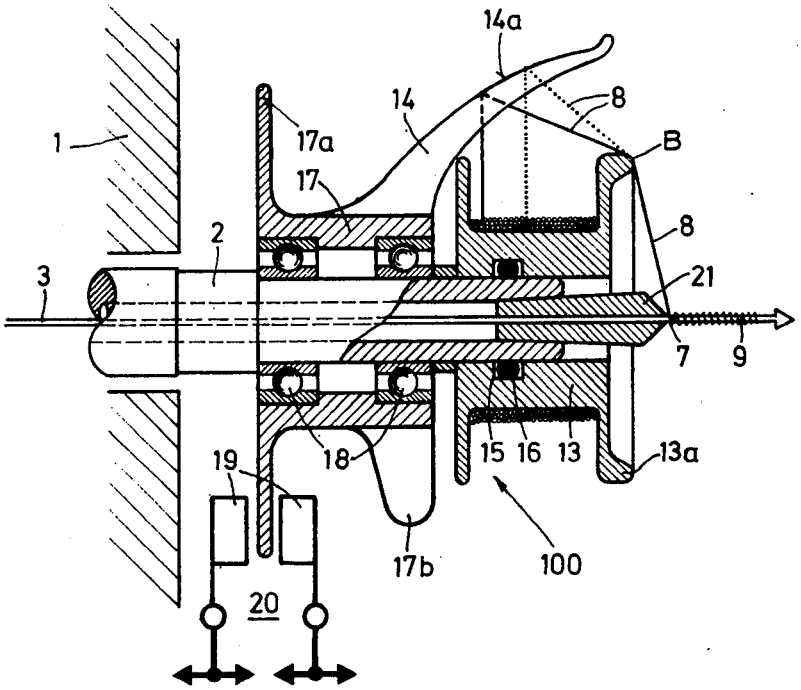
Figure 3:
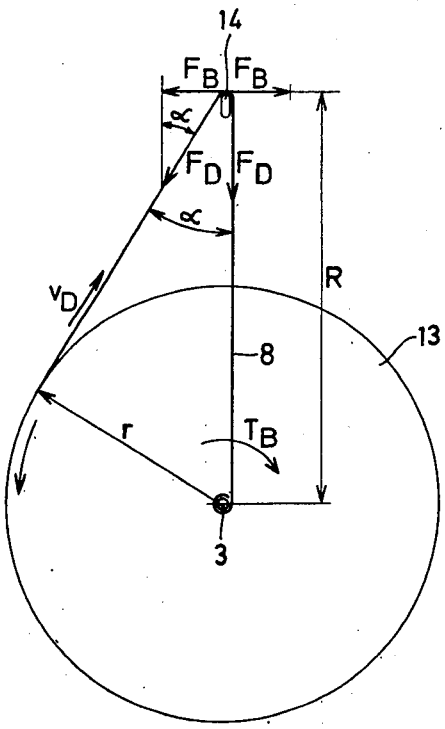
Figure 4:
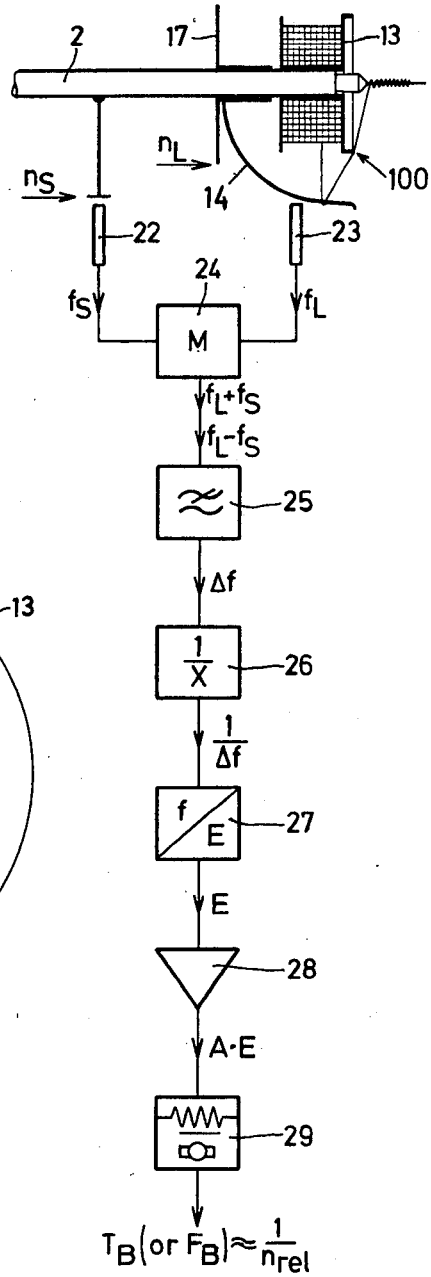

A preferred embodiment of the invention will now be described in detail with reference to the accompanying drawings, in which:

FIG. 1 is a diagrammatic perspective view of the coiling machine from which numerous details not necessary for the understanding of the invention have been omitted, FIG. 2 is a partial axial section of the part of the machine designated as a whole as 100 in FIG. 1, FIG. 3 is an explanatory diagram of the theory upon which the invention is based, and FIG. 4 is block diagram of a brake control device.

Except for the details illustrated in FIG. 2, the machine for coiling filaments for incandescent bulbs or gas discharge tubes, shown incompletely and diagrammatically in FIG. 1, is designed identically to the aforementioned "Swisscoiler" machine. Mounted for rotation in a housing 1 is a hollow spindle 2 which is rotated at high speed by a motor drive (not shown). A support-wire 3 is drawn off a supply reel 4, runs over guide rollers 5, 6, and then through the hollow spindle 2, at the front end of which there is a location 7 at which an 0.018-mm-thick tungsten wire 8, for example, is coiled on the support-wire 3. The structure 9 thus formed, consisting of the support-wire 3 with the wire 8 coiled around it, runs over rollers of a feed device 10 and over a guide roller 11 to a take-up reel 12. The wire 8 is drawn off a supply reel 13 and diverted by a guide member 14 before it reaches the coiling location 7.

As may be seen in FIG. 2, the supply reel 13 has in the wall of its bore an annular groove 15 in which a rubber ring 16 is inserted, so that the reel 13 is mounted on the spindle 2 to be substantially integral in rotation therewith but can nevertheless be pulled off the spindle 2. The cheek of the reel 13 nearest the coiling location 7 has an outer rim **13*a* against which the wire 8 is additionally diverted during its travel from the guide member 14 to the coiling location 7**.

The guide member 14 takes the form of a thin arm projecting out over the reel 13 from a rotor 17 which, by means of two ball-bearings 18 is mounted to be readily rotatable but not slidable on the spindle 2. At the end of it remote from the reel 13, the rotor 17 has a flat flange **17*a* serving as a brake-disc against which brake-shoes 19 of a braking device 20 can be pressed. An appendage 17*b* of the rotor 17 serves as a counterbalance to the guide member 14, so that the rotor 17 including the guide member 14** is perfectly balanced.

The front end portion of the spindle 2 consists of an inter-changeable insert part 21, the bore of which closely guides the support-wire 3.

In the machine being described, the supply reel 13 rotates at the same high speed, e.g. 30,000 rpm, as the spindle 2, whereas the rotor 17 is driven only by the wire 8, as a result of the deviation of the latter at the guide member 14, at a speed which differs from that of the reel 13 because of the wire withdrawal. The wire tension $F_D$ in the wire 8 approaching the coiling location 7 depends upon the radius $r$ of the particular layer of turns from which the wire 8 is being drawn off (cf. also FIG. 3), upon the radius $R$ of the point of deviation on the guide arm 14 at any given moment, and upon the braking torque $T_B$ produced by the braking device 20 at the flange **17*a***; the braking torque $T_B$ brings about the brake force $F_B$ at the point of deviation.

The following equations can be derived from FIG. 3:

$$F_B = F_D \cdot \sin\alpha \quad (1)$$

$$\sin\alpha = (r/R) \quad (2)$$

$$T_B = F_B \cdot R \quad (3)$$

$$F_D = \frac{F_B}{\sin\alpha} = \frac{T_B}{R \cdot \sin\alpha} = \frac{T_B \cdot R}{R \cdot r} \quad (4)$$

$$F_D = \frac{T_B}{r}$$

It follows that if the wire tension $F_D$ is supposed to be constant, $$T_B \approx (1/r) . \quad (5)$$

If the relationship between the braking torque $T_B$ and the relative speed of rotation $n_{rel}$, i.e., the difference between the speeds of rotation of the supply reel 13 and the rotor 14, 17, is sought for the automatic control of the braking device 20, the following equations may be derived from FIG. 3, where $v_D$ stands for the speed of the wire:

$$v_D = 2\pi r n_{rel} \quad (6)$$

when $v_D$ is constant, equations (4) and (5) result in the following:

$$T_B = F_D \cdot (v_D/n_{rel}) \quad (7)$$

and when $F_D$ is constant:

$$T_B \approx \frac{1}{n_{rel}} \quad (8)$$

Thus the equation (8) may be used as a basis for the automatic control of the braking device 20 for maintaining the wire tension $F_D$ constant. A suitable control device is illustrated in the block diagram, FIG. 4.

First two speed detectors 22, 23 form the appurtenant frequencies $f_S$ and $f_L$ from the speeds of rotation $n_S$ of the spindle 2 and $n_L$ of the rotor 17.

These two frequencies are then mixed in a mixer 24. The mixer 24 delivers among other things the sum $f_I + f_S$ of and the difference $f_L - f_S$ between the two frequencies, whereupon a low-pass filter 25 eliminates the sum $f_L + f_S$. The difference $\Delta f = f_L - f_S$ corresponds to the relative speed of rotation $n_{rel}$ of the rotor 17. The value $\Delta f$ is then inverted to $(1/\Delta f)$ in an inverter 26, i.e., the period is determined; the quantity $(1/\Delta f)$ is thereupon converted into a voltage E porportionate thereto in a converter 27, and this voltage is subsequently amplified A-fold in an amplifier 28. Finally, in a drive unit 29, which may, for example, consist chiefly of an electromagnet or of a motor, the braking torque $T_B$ is produced, or possibly the brake force $F_B$ by means of the brake-shoes 19 (FIG. 2), to such an extent that the constant wire tension $F_D$ results.

The guide edge 14*a* of the guide member 14 runs along a parabola, the focal point B of which (FIG. 2) is situated on the active surface of the guide rim 13*a* on the supply reel 13. It is thereby achieved in the simplest way possible that the wire 8, regardless of the reciprocating movement of the unwinding location along the longitudinal axis. of the reel 13, always lies in a radial plane during its travel between the unwinding location and the guiding edge 14*a,* hence that the actual wire withdrawal is never perturbed by adjacent turns of wire, and as a result, no sudden variations in the wire tensions occur either. Thus breakage of the extremely fine wire 8 can easily be avoided.

All in all, the machine designed according to this invention enables the speed of rotation of the spindle to be increased, as compared with the "Swisscoiler" machine mentioned earlier, from about 10,000rpm to 30,000rpm, thus increasing the production-rate accordingly; it also makes it possible to eliminate wire breakage almost completely and to carry out the coiling at a substantially constant wire tension.

What is claimed is:

1. A machine for coiling filaments for incandescent bulbs or gas discharge tubes comprising, a motor-driven spindle, a supply reel mounted on said spindle for holding a supply of filament-wire, a rotor carrying a guide member mounted on said spindle, a motor-driven feed means for continuously advancing a support-wire through said spindle, said filament-wire describing a path between an unwinding location on said reel and a coiling location adjacent to an end of said spindle where said filament-wire is coiled on said support-wire, said guide member including a projecting arm adapted to deviate said filament-wire along said path, said rotor and said guide member being freely rotatable under the influence of said deviated filament on said spindle, said reel being integral in rotation with said spindle.

2. The machine defined in claim 1, further comprising a braking device and control means, said braking device acting upon said rotor, and said control means automatically controlling said braking means for maintaining a constant tension on said filament-wire as a function of the decrease in the radius of said supply of filament-wire on said reel.

3. The machine defined in claim 1, wherein said guide member comprises a guiding edge, and said reel comprises a rim adjacent to said coiling location, said guiding edge extending along a parabola having its focal point on said rim.

* * * * *